US009451349B2

(12) United States Patent
Wickstrom et al.

(10) Patent No.: US 9,451,349 B2
(45) **Date of Patent: *Sep. 20, 2016**

(54) EARPHONE ASSEMBLY WITH MOISTURE RESISTANCE

(71) Applicant: Knowles Electronics, LLC, Itasca, IL (US)

(72) Inventors: Timothy K. Wickstrom, Elk Grove Village, IL (US); William J. Ballad, Buffalo Grove, IL (US); Ying-Tzu Chan, Taipei (TW); Mei-Yu Lin, Taipei (TW); Jen Nan Feng, Zhongli (TW)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/755,716

(22) Filed: Jun. 30, 2015

(65) Prior Publication Data

US 2015/0304755 A1 Oct. 22, 2015

Related U.S. Application Data

(63) Continuation of application No. 14/021,625, filed on Sep. 9, 2013, now Pat. No. 9,078,064, which is a continuation of application No. 13/009,234, filed on Jan. 19, 2011, now Pat. No. 8,532,323.

(60) Provisional application No. 61/296,153, filed on Jan. 19, 2010.

(51) Int. Cl.
*H04R 25/00* (2006.01)
*H04R 1/10* (2006.01)

(52) U.S. Cl.
CPC ..... *H04R 1/10* (2013.01); *H04R 1/1091* (2013.01)

(58) Field of Classification Search
CPC ..... H04R 25/00; H04R 1/10; H04R 1/1091
USPC ..... 381/322, 324, 425, 382, 165, 353
See application file for complete search history.

(56) References Cited

U.S. PATENT DOCUMENTS

| | | | | |
|---|---|---|---|---|
| 5,222,050 | A * | 6/1993 | Marren | H04R 11/00 181/132 |
| 7,751,579 | B2 * | 7/2010 | Schulein | H04R 1/12 181/129 |
| 8,160,261 | B2 * | 4/2012 | Schulein | H03G 3/32 381/119 |
| 8,532,323 | B2 | 9/2013 | Wickstrom et al. | |
| 9,078,064 | B2 | 7/2015 | Wickstrom et al. | |
| 2002/0039427 | A1 | 4/2002 | Whitwell et al. | |
| 2003/0085070 | A1 | 5/2003 | Wickstrom et al. | |
| 2004/0010181 | A1 | 1/2004 | Feeley et al. | |
| 2009/0060246 | A1 | 3/2009 | Baliga et al. | |

* cited by examiner

*Primary Examiner* — Tuan D Nguyen
(74) *Attorney, Agent, or Firm* — Fitch, Even, Tabin & Flannery LLP

(57) ABSTRACT

An acoustic system includes a conduit, a microphone coupled to an end of the conduit, and a rigid moisture resistant barrier coupled to another end of the conduit to prevent moisture from traversing the length of the conduit towards the receiver. The moisture resistant barrier dampens an audio signal traversing the conduit. The moisture resistant barrier has a submersion rating at least equal to a 7 Ingress Protection rating.

21 Claims, 13 Drawing Sheets

EARPHONE ASSEMBLY WITH MOISTURE RESISTANCE

CROSS REFERENCE TO RELATED APPLICATIONS

This application is a continuation of prior U.S. application Ser. No. 14/021,625 filed on Sep. 9, 2013 entitled "Earphone Assembly with Moisture Resistance," now U.S. Pat. No. 9,078,064, which is a continuation of prior U.S. application Ser. No. 13/009,234 filed Jan. 19, 2011 entitled "Earphone Assembly with Moisture Resistance," now U.S. Pat. No. 8,532,323, which claims benefit under 35 U.S.C. §119(e) to U.S. Provisional Application No. 61/296,153 entitled "Earphone Assembly with Moisture Resistance" filed Jan. 19, 2010, the content of all of which are incorporated herein by reference in their entireties.

TECHNICAL FIELD

This disclosure relates to earphone assemblies and more specifically, earphone assemblies that prevent moisture intrusion.

BACKGROUND

Earphones typically include a housing that holds a speaker and/or a microphone and this earphone assembly is often placed at least partially in the ear canal of a user. Additionally, in some of these previous systems an acoustic tube communicates with the speaker/microphone at one of its ends and provides an acoustic path to/from the user's ear canal via an unobstructed opening at the other of its ends. If the open end of the tube is blocked or sealed in these previous systems, sound quality becomes significantly degraded.

In some circumstances, the user places the unit into their ear and leaves it there for long periods of time without removal. However, in many circumstances the unit is taken in and out of the ear repeatedly. For instance, the user may wish to remove the unit when they go swimming and replace it when they are finished swimming. In other examples, the user may wear the unit on the train or in a car while listening to music, but may remove the unit when they are finished listening to the music.

When the unit is removed from the ear (and sometimes when the unit is present in the ear), it may be exposed to some form of moisture (e.g., dropped in water, inadvertently sprayed with chemicals, or exposed to the elements to mention a few examples). Since the end of the tube is open, water or other types of moisture can easily enter the tube. Sometimes, the moisture can move so far into the tube as to reach where the electrical components reside and the moisture can damage or destroy these components. In other circumstances, the moisture does not move far enough through the tube to contact or damage the components, but instead remains in the tube. This moisture pooling in the tube has the unfortunate effect of damping or blocking the sounds traversing through the tube. In any of these situations, sound quality becomes degraded. Consequently, the user is not able to hear certain sounds, particularly at high frequencies.

Previous approaches have inadequately addressed the above mentioned problems. More specifically, previous approaches have failed to both allow sound to pass in and out of the tube without becoming significantly degraded, and prevent moisture intrusion into the acoustic tube of earphones.

BRIEF DESCRIPTION OF THE DRAWINGS

For a more complete understanding of the disclosure, reference should be made to the following detailed description and accompanying drawings wherein.

Figure 1:
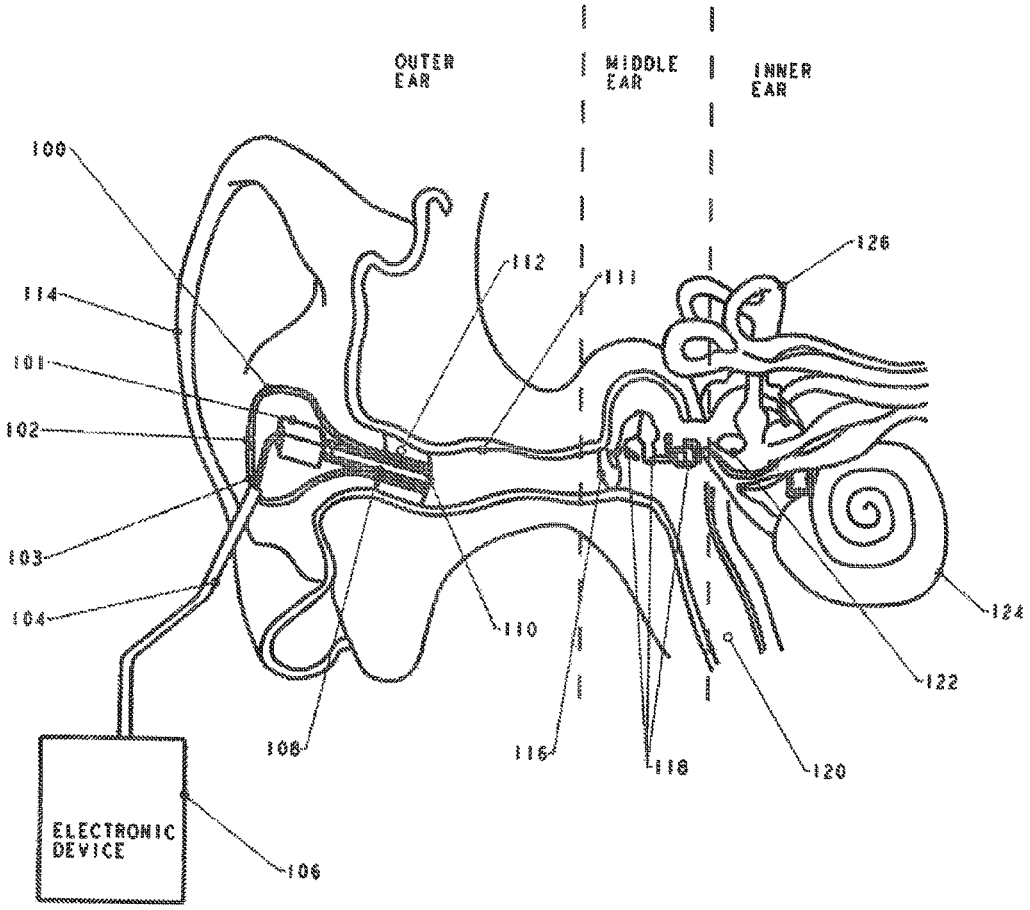
FIG. 1 is a block diagram of a system for preventing moisture intrusion into an earphone.

Those of ordinary skill in the art will appreciate that elements in the figures are illustrated for simplicity and clarity. It will be appreciated further that certain actions and/or steps may be described or depicted in a particular order of occurrence while those of ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to be limited to the particular forms described, but to the contrary, the disclosure is intended to cover all modifications, alternatives, and equivalents.

Approaches are provided whereby an acoustic tube of an earphone includes a barrier and the barrier prevents all or substantially all moisture intrusion into the acoustic tube from outside the tube. At the same time, the barrier is configured to allow sound to pass therethrough so that the quality of the sound does not become significantly degraded.

The barrier used is small in cross-sectional area. By "small", it is meant that the barrier can comfortably fit into the human ear without causing significant discomfort or injury to the user. Additionally, if the barrier were comprised of a membrane of similar size to the barrier, it would behave as a diaphragm and introduce sufficient reactance to the acoustic signal to degrade frequency response and/or cause distortion. The present approaches introduce little or no additional reactance so these degradation problems are avoided. Although many possible dimensions may be used, in one example the barrier is a circular metal screen approximately 1.6 to 2.0 mm in diameter. In other examples, the barrier is constructed from polyamide. Other shapes, materials, and dimensions are possible.

So configured, damping of sound due to moisture in the tube is substantially or totally eliminated. Further, moisture or liquids are prevented from damaging, destroying, or otherwise adversely impacting elements of the earphone such as speaker and microphone components. At the same time and as mentioned, the user of the earphone does not experience significant degradation of sound quality.

In many of these embodiments, an earphone includes a speaker (and/or a microphone) and an acoustic tube. A first end of the tube communicates with the speaker (and/or microphone) while a second end communicates with at least a portion of the outer ear of a user. The second end includes a barrier and the barrier prevents all or substantially all moisture intrusion from outside the earphone and into the tube. By "substantially all," it is meant that any moisture intrusion (if there is any) does not reach the speaker (and/or microphone or their components) and/or does not produce significant damping of sound that passes through the tube. Alternatively, the barrier may be coupled to the speaker and/or microphone directly or as part of a flu or cup-like apparatus which itself is coupled to the speaker and/or microphone.

It will be appreciated that although the term "earphone" is used herein, it will be understood that the present approaches are applicable to all devices that may include speakers and/or microphones in any number or combination and that are placed or positioned at or in any portion of the human ear. And although the description herein is made in terms of the unit being an "in-the-ear" unit, it will be appreciated that the approaches described herein may also be applied to partially in-the-ear units, or out-of-the-ear units to mention two examples. It will further be appreciated that although the description may be in terms of preventing intrusion of water, the approaches described herein are applicable to all forms of moisture or liquids including water, oil, human perspiration, and chemicals to mention a few examples.

In many of these embodiments, an acoustic system includes a receiver, a tube, a barrier, and an equalization device. The receiver is capable of outputting an audio signal. The tube is in connection with the receiver and the audio signal travels along a length of the tube. The barrier is fitted along the tube and the barrier prevents moisture from passing along the tube toward the receiver. The barrier causes an amount of damping to the audio signal. The equalization device is in connection with the receiver and the equalization device counteracts the damping by the barrier. The barrier is configured to have a submersion rating greater than or equal to 7 Ingress Protection (IP).

In some aspects, the equalization device is a high-pass filter. In other aspects, the barrier is positioned at an end of the tube. In some other aspects, the barrier is positioned adjacent to the receiver. In still other aspects, the barrier has openings of approximately 6.5 micrometers in diameter.

In others of these embodiments, an acoustic system includes a microphone, a tube, a barrier, and an equalization device. The microphone is capable of receiving an audio signal. The tube is in connection with the microphone and the audio signal travels along a length of the tube. A barrier is fitted along the tube and the barrier prevents moisture from passing along the tube toward the microphone. The barrier causes an amount of damping to the audio signal. The equalization device is in connection with the microphone and the equalization device counteracts the damping by the barrier. The barrier is configured to have a submersion rating greater than or equal to 7 IP.

In some aspects, the equalization device is a high-pass filter. In other aspects, the barrier is positioned at an end of the tube. In still other aspects, the barrier is positioned adjacent to the microphone. In still other aspects, the barrier has openings of approximately 6.5 micrometers in diameter. In other aspects, the equalization device may be omitted.

In others of these embodiments, an acoustic system includes a receiver (or microphone), a tube, or a moisture resistant screen. The receiver is capable of outputting an audio signal, while the microphone receives an audio signal. The tube is in connection with the receiver (or microphone) and the audio signal travels along a length of the tube. The moisture resistant screen is fitted at an end of the tube. The moisture resistant screen prevents moisture from passing along the tube toward the receiver, and causes an amount of damping to the audio signal. The moisture resistant screen is configured to have a submersion rating greater than or equal to 7 IP.

Referring now to FIG. 1, one example of an approach for preventing moisture intrusion into an earphone is described. An earphone 100 includes a receiver module 101, an earphone housing 102, a tube 108, a barrier 110, and a flexible tip/gasket 112. A cable 104 couples the earphone 100 to an electronic device 106.

The electronic device 106 is any type of electronic device that communicates sounds to the earphone 100. For example, the electronic device 106 may be a radio, walkman, CD player, DVD player, cellular phone, or personal computer. Other examples of electronic devices are possible.

The earphone 100 is positioned in the pinna 114 of the ear and at least partially within the ear canal 111 of the ear. As shown in FIG. 1, the ear is generally divided into the outer ear, the middle ear, and the inner ear. The outer ear includes the pinna 114; the middle ear includes the eardrum 116, ossicles 118, and Eustachian tube 120; and the inner ear includes the semicircular canals 126, round window 122, and cochlea 124. The function of these human ear components is well known and will not be described further herein.

The receiver module 101 includes various electrical and mechanical elements. For example, the receiver module may include a speaker (and the electrical and mechanical components of a speaker) and/or a microphone (and the electrical and components of a microphone). The receiver module 101 is coupled to the tube 108. In one example, the receiver module is a CI series receiver manufactured by Knowles Electronics, LLC. Other examples of receivers are possible. The tube 108 may be constructed of any suitable material such as plastic and, in one example, is approximately 10 mm long and 1 mm in diameter.

In FIG. 1, the barrier 110 is coupled to or is disposed at the end of the tube 108. In one example, the barrier 110 is a metal mesh screen that is secured to the end of the tube 108 by a small bushing and adhesive (e.g., glue). In another example, the barrier is constructed from polyamide. Various types of fasteners may also be used to secure the barrier 110 to the tube 108. In another example, the barrier 110 is a removable plug that includes a screen. In still other examples, the barrier 110 is a screw-on part (e.g., a lid) that screws onto the end of the tube 108. Other examples of barriers are possible.

The barrier 110 is configured so that sound passes through the barrier 110. At the same time, the barrier 110 is configured to prevent moisture intrusion into the earphone 100 from outside of the earphone 100. For example, the earphone 100 may be removed by the user from their ear when they go swimming or when they sleep to mention two examples. During this time when the earphone 100 is removed from the ear of the user and especially susceptible to attack by moisture or liquids (but also when it in the ear of the user), the present approaches prevent moisture intrusion into the earphone 100.

In preventing moisture intrusion, it is meant that moisture will not pass from one side of the barrier 110 to the other side of the barrier 110 for a given set of conditions or under a standard. To take one example, under Ingress Protection standards, the barrier 110 may have a rating of approximately 7 indicating no substantial water leakage occurs at a liquid depth of 1 meter for one-half hour. The degree of barrier moisture permeability selected by the user varies based upon the application and circumstances of the user.

In the examples herein, the barrier 110 is positioned at the end of the tube 108 or very near (e.g., within a few millimeters) of the end. However, it will be appreciated that in some configurations the barrier 110 can be more inward in the tube 108.

It will be appreciated that the barrier 110 may also be treated with a moisture repellant material to further repel moisture. For example, the barrier 110 may be treated with a fluorocarbon based anti-wetting agent. Other examples of moisture repellant materials and treatments are possible.

The present arrangements prevent intrusion of substantially any liquid or moisture into the acoustic tube 108. Additionally and as will be described elsewhere herein, equal or substantially equal pressures are maintained as between the exterior of the earphone and interior portions of the earphone 100. The equal or substantially equal pressures ensure proper operation of the receiver module 101.

The size and shape of the openings in the barrier 110 are selected to be small enough to prevent moisture form passing through the barrier at a selected fluid pressure. As mentioned and to take one example, the barrier is a metal mesh screen that has openings. In this example, the openings are circular holes of approximately 6.5 micrometer diameter and that produce an approximate 7 IP submersion rating for the barrier 110. "7 IP" as is known refers to protection against the effects of immersion in water between 15 cm and 1 m for 30 minutes.

In some situations, the barrier 110 may act as a damping element that has a damping effect on sound that passes therethrough. At high frequencies the damping is greater than at lower frequencies. In fact, at DC frequencies no (or very little) damping may occur. In some examples, an additional high pass filter 103 is used to compensate. This high pass filter 103 can be disposed at either the electronic device 106 or the earphone 100 although in FIG. 1 it is shown at the receiver 101 of the earphone 100. The power of the transmitted signal from the electronic device 106 may be increased as well. By "increasing" the power, what is meant is that the drive level is increased beyond that normally associated with the normal operation of earphones. For example, the power may be increased by approximately 400 percent, for example, from 0.1 Vrms to 0.4 Vrms over the drive level used during operations with no barrier present. The increased power and/or the high pass filter serve to pass high frequency signals through to the barrier 110 with little or no degradation of signal quality.

Figure 2:
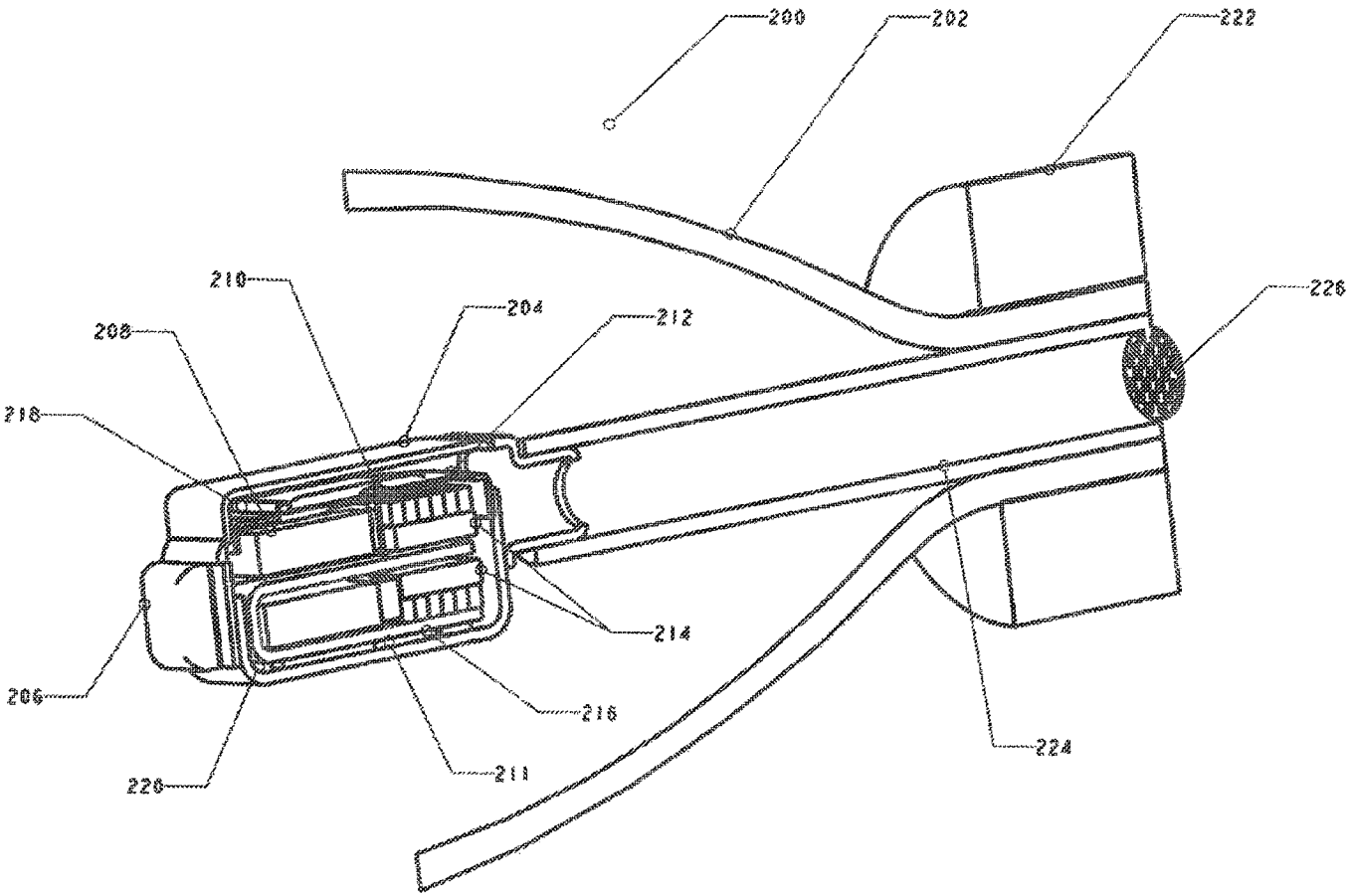
FIG. 2 is a cut-away perspective view of one example of an apparatus including a speaker for preventing moisture intrusion into an earphone.

Referring now to FIG. 2, one example of an apparatus for preventing moisture intrusion into an earphone 200 is described. The earphone 200 includes a housing 202 that can be constructed of any suitable material such as plastic and/or metal. A speaker module 204 is disposed inside the housing 202. The speaker module 204 includes an input terminal 206, a coil 208, a drive rod 210, a diaphragm 212, magnets 214, an armature 216, a front cavity 218, and a rear cavity 220. The speaker module 204 may also include one or more pierced holes or openings, for example, in the diaphragm 212 to allow barometric venting or pressure equalization to occur. The speaker module 204 couples to the tube 224 at the front cavity. The tube 224 has a barrier 226 attached at its end. The speaker module 204 includes an outer housing 211 that houses the above-mentioned components and this outer housing 211 may be constructed of any suitable material such as plastic.

A flexible ear tip gasket 222 extends around portions of the tube 224 and housing 202. The flexible ear tip gasket 222 may be constructed from any suitable material such as those materials that are comfortable for human wear such as foam, rubber, or the like.

In operation, the speaker module 204 receives electrical signals from a device that is positioned outside of the earphone (e.g., the electronic device 106 of FIG. 1). In this respect, a wire (not shown in FIG. 2) from this outside device couples to the input terminal 206. In other aspects, the device may be positioned inside the earphone.

The coil 208 is driven by the received signals and induces a magnetic field on the armature 216 to move the armature 216. The magnets 214 have a permanent charge and as the armature 216 moves, the diaphragm 212 moves via the drive rod 212. The diaphragm 212 acts to create sounds in the tube 224 as the diaphragm 212 moves and these sounds are acoustically transmitted through openings in the speaker module, through the tube 224 and through the barrier 226 to the ear of the user to be heard.

In this example, the barrier 226 is a metal screen 1.6 to 2.0 mm in diameter that is attached to a small bushing at the end of the tube 224. However, it will be appreciated that the barrier 226 may assume other configurations such as a removable plug (that includes a screen) or a screwed-on lid. In this example, the openings of the barrier are circular holes of approximately 6.5 micrometer diameter and that produce an approximate 7 IP submersion rating for the barrier 226. Other examples and configurations of barriers are possible.

It will be appreciated that a barrier so configured and dimensioned to have such a small cross-sectional area comfortably fits into the human ear without causing significant discomfort or an injury to the user. Additionally, little or no reactance is introduced due to this small size. Therefore, the frequency response of the acoustic signal is not significantly degraded and significant distortion of this signal does not occur.

It will be appreciated that in this example, the barrier prevents all or substantially all moisture or liquid intrusion from the exterior of the earphone into the tube 224. More specifically, intrusion of substantially any liquid (e.g., water, a water mixture, or moisture) having a surface tension equal or greater than water is prevented. On the other hand and at the same time, sound can penetrate the barrier 226 to be heard by a user. As mentioned, a high pass filter can be added to the speaker module 204 and/or the power of the signal sent to the module 204 from the external device can be increased over the power which would be used in the absence of a screen. In this way, further improved reception by the user of high frequency signals from the external device may be achieved. In addition, the pressure external to the tube 224, within the tube 224, and within the front and rear cavities 218 and 220 is equalized or substantially equalized so that optimum operation of the speaker module 204 is achieved and maintained.

Figure 3:
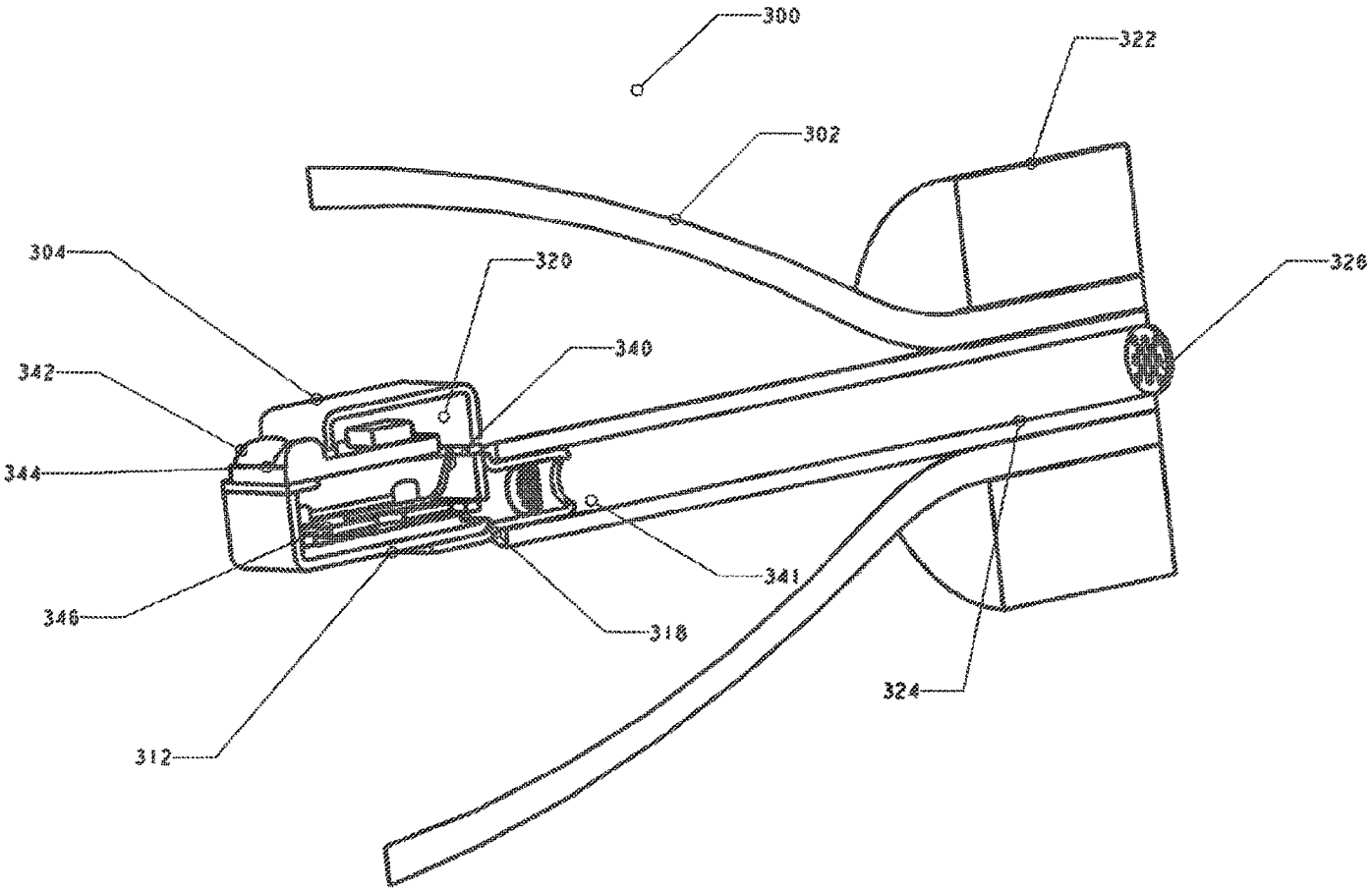
FIG. 3 is a cut-away perspective view of one example of an apparatus including a microphone for preventing moisture intrusion into an earphone.

Referring now to FIG. 3, one example of an apparatus for preventing moisture intrusion into an earphone 300 is described. More specifically, intrusion of substantially any liquid (e.g., water, a water mixture, or moisture) having a surface tension equal or greater than water is prevented. The earphone 300 includes a housing 302 that can be constructed of any suitable material such as plastic. A microphone module 304 is disposed inside the housing 302. The microphone module 304 includes an output terminal 342, a wire 340, an amplifier 344, a charge plate 346, a diaphragm 312, a front cavity 318, and a rear cavity 320. The microphone module 304 may also include one or more pierced holes or openings, for example, in the diaphragm 312 to allow barometric venting or pressure equalization to occur. The microphone module 304 couples to the tube 324. The tube 324 has a barrier 326 attached or secured at its end. A flexible ear tip gasket 322 extends around portions of the tube 308 and housing 302. The flexible ear tip gasket 322 may be constructed from any material that is comfortable for human wear such as foam or the like.

In operation, the microphone module 304 receives a sound pressure (indicated by an arrow labeled 341) via the tube 324. At this point, the sound pressure has successfully moved past the barrier 326 and through the tube 324 to the front cavity 318. The sound pressure 341 passes through openings in the microphone module 304 and moves the diaphragm 312. Movement of the diaphragm 312 causes a change in charge of the charged plate 346, which connects to the amplifier 344 via the wire 340. The amplifier 344 couples to the output terminal 342 and lowers the impedance of the electrical signal for presentation at the output terminal 342.

In this example, the barrier 326 is a metal screen that is attached to a small bushing at the end of the tube 324. However, it will be appreciated that the barrier 326 may assume other configurations such as a removable plug (that includes a screen) or a screw-on lid. In this example, the openings of the barrier are circular holes of approximately 6.5 micrometer diameter and that produce an approximate 7 IP submersion rating for the barrier 326. Other examples and configurations of barriers are possible. Other examples of barriers and barrier construction are possible.

It will be appreciated that in this example, the barrier 326 prevents all or substantially all moisture or liquid from the exterior of the earphone 300 to enter the tube 324. On the other hand, sound can penetrate the barrier 326 for processing by the microphone module 304. In addition, the pressure external to the tube 324, within the tube 324, and within the front and rear cavities 318 and 320 is equalized so that optimum operation of the microphone module 304 is achieved and maintained.

Figure 4:
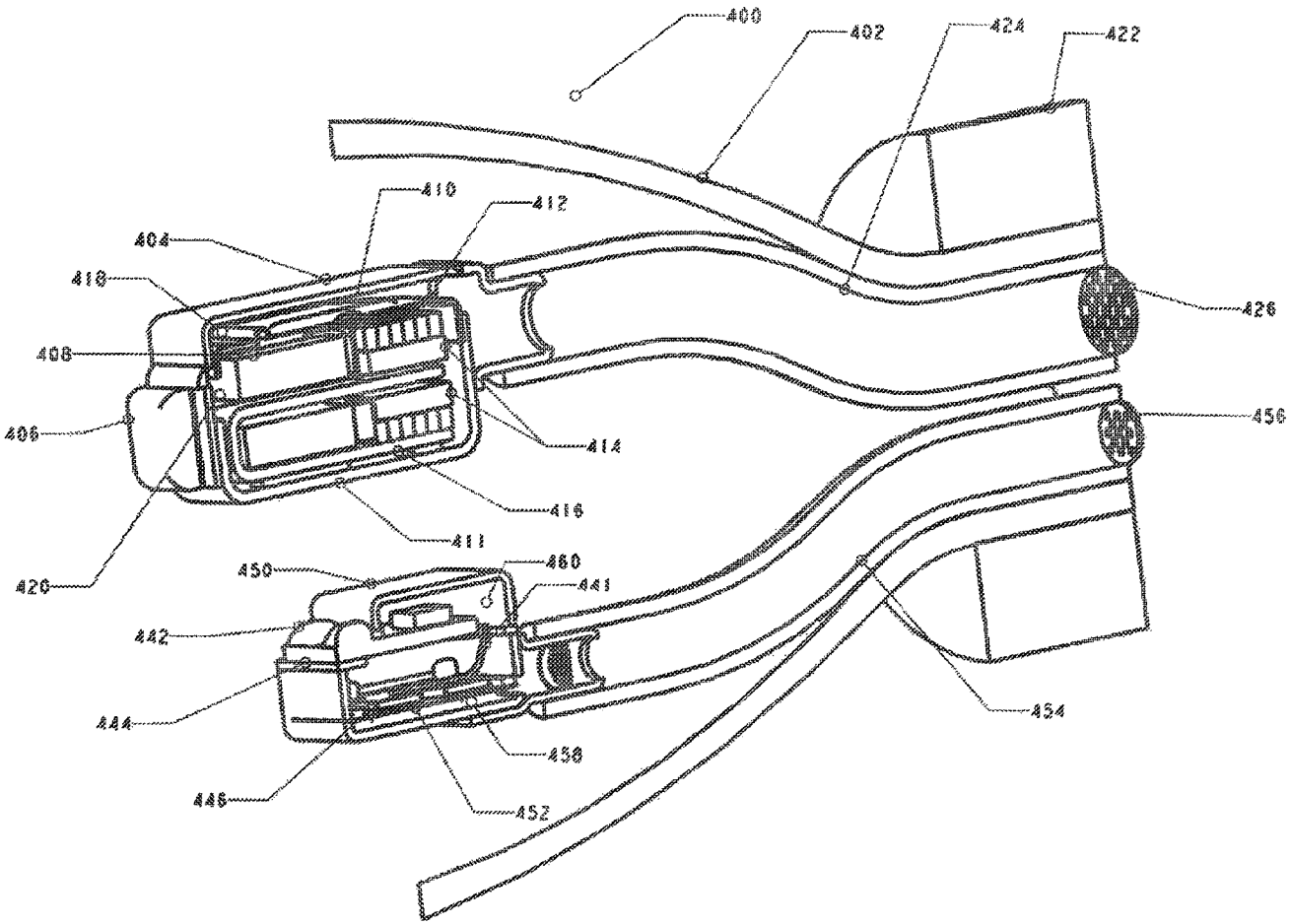
FIG. 4 is a cut-away perspective view of one example of an apparatus including a speaker and a microphone for preventing moisture intrusion into an earphone.

Referring now to FIG. 4, one example of an apparatus for preventing moisture intrusion into an earphone 400 is described. In this example, both a microphone module and a speaker module are disposed within the earphone. More specifically, the earphone 400 includes a housing 402 that can be constructed of any suitable material such as plastic and/or metal. A speaker module 404 is positioned inside the housing 402. The speaker module 404 includes an input terminal 406, a coil 408, a drive rod 410, a diaphragm 412, magnets 414, an armature 416, a front cavity 418 and a rear cavity 420. The speaker module 404 may also include one or more pierced holes or openings, for example, in the diaphragm 412 to allow barometric venting or pressure equalization to occur. The speaker module 404 couples to the tube 424 at the front cavity 418. The tube 424 has a barrier 426 attached at its end. The speaker module 404 includes an outer housing 411 and this outer housing 411 may be constructed of any suitable material such as plastic. The operation of these components is the same as that for similar components of FIG. 2 and will not be discussed again here.

A flexible ear tip gasket 422 extends around portions of the tube 424 and housing 402. The flexible ear tip gasket 422 may be constructed from any material that is compatible or comfortable for human wear such as foam or the like.

Further, in the example of FIG. 4 a microphone module 450 is also positioned inside the housing 402. The microphone module 450 includes an output terminal 442, a wire 441, an amplifier 444, a charge plate 446, a diaphragm 452, a front cavity 458, and a rear cavity 460. The microphone module 450 may also include one or more pierced holes, for example, in the diaphragm 452 to allow barometric venting or pressure equalization to occur. The microphone module 450 couples to the tube 454. The tube 454 has a barrier 456 attached at its end. The flexible ear tip gasket 422 extends around portions of the tube 454. The operation of these components is the same as for similar components in FIG. 3 and will not be discussed again here.

As can be seen in FIG. 4, each of the tubes 424 and 454 has separate barriers at their respective ends. In other examples, a single tube is used and attaches to both the speaker module 404 and the microphone module 450.

It will be appreciated that in this example, the barriers 426 and 456 prevent all or substantially all moisture from the exterior of the earphone from entering the tubes 424 and 454. More specifically, intrusion of substantially any liquid (e.g., water, a water mixture, or moisture) having a surface tension equal or greater than water is prevented. On the other hand, sound can penetrate the barriers 426 and 454 to be heard by a user and received at the microphone module 450. In conjunction with the speaker module 404, a high pass filter can be added to the speaker module 404 and/or the power of the signal sent to the module 404 from the external device can also be increased over the power that would be used in the absence of a barrier. In this way, further improved reception by the user of high frequency signals from the external device may be achieved. In addition, the pressures external to the tubes 424 and 454, within the tube 424 and 454, and within the front and rear cavities 418, 458 and 420, 460 are equalized or substantially equalized so that optimum operation of the speaker module 404 and the microphone module 450 is achieved and maintained.

Figure 5:
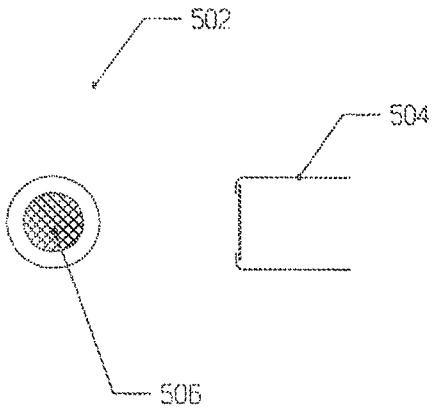
FIG. 5 is one example of a barrier.

Referring now to FIG. 5, one example of a barrier 502 is described. In this example, the barrier 502 includes a metal cup 504. A metal screen 506 with suitably-sized openings is secured to the end of the cup 504. Any suitable adhesive (e.g., glue) or other fastening arrangement may be used to secure the screen 506.

Figure 6:
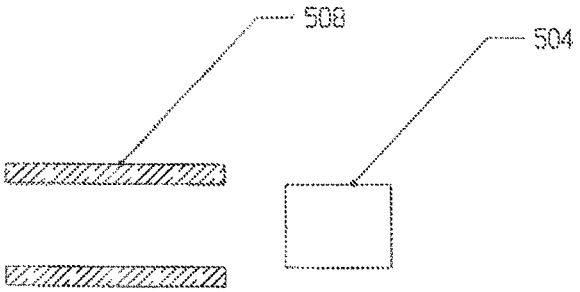
FIG. 6 is one example of usage of the barrier of FIG. 5.

Referring now to FIG. 6, the cup 504 is placed in a tube 508 of the earphone. As mentioned, the cup 504 includes a screen portion 506. The metal cup 504 is inserted into the end of the tube 508. The cup 504 can be removed from the tube 508 depending upon its configuration by a tool or in some circumstances manually. So configured, the cup 504 may be replaced if soiled or damaged. For example, the accumulation of ear wax may soil the screen such that the cup 504 should be periodically replaced by a user. As described elsewhere herein, the cup 504 can be moved to the other end of the tubing and couple directly to the receiver.

Figure 7:
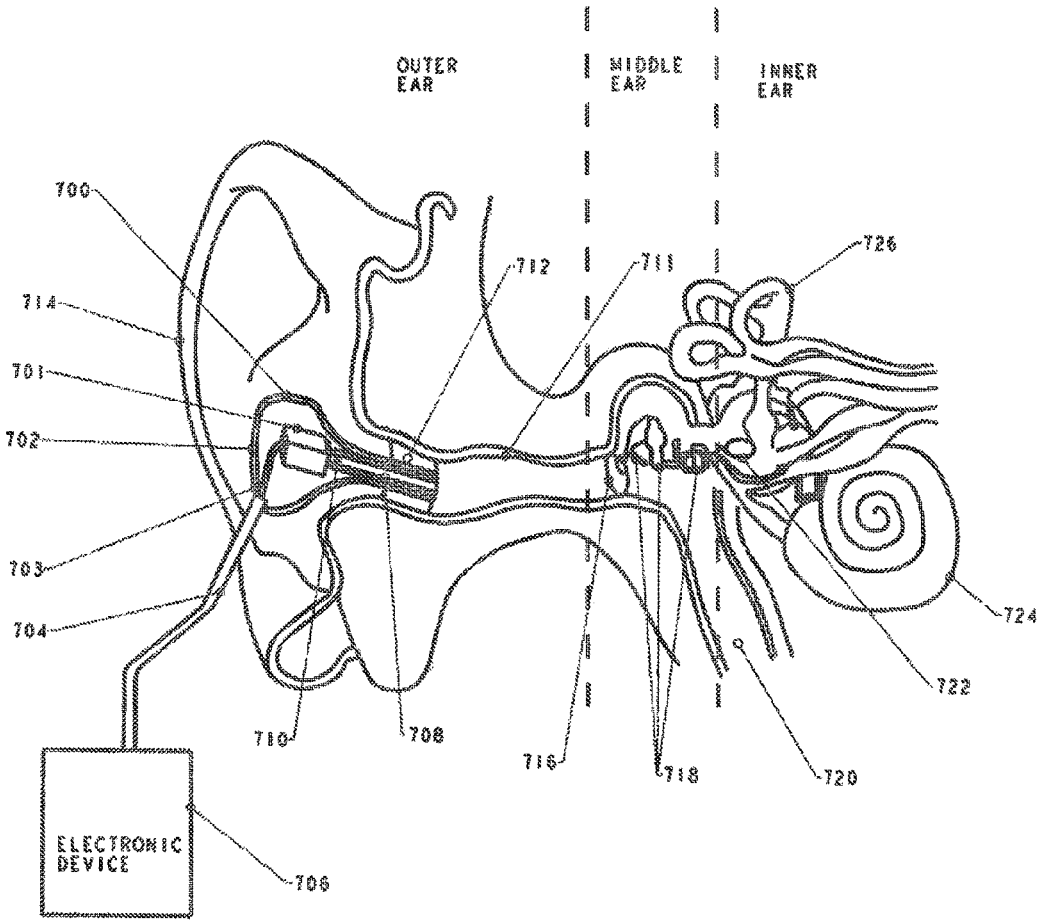
FIG. 7 is a block diagram of another example of a system for preventing moisture intrusion into portions of an earphone.

Referring now to FIG. 7, another example of an approach for preventing moisture intrusion into portions of an earphone is described. An earphone 700 includes a receiver module 701, an earphone housing 702, a tube 708, a barrier 710, and a flexible tip/gasket 712. A cable 704 couples the earphone 700 to an electronic device 706.

The electronic device 706 is any type of electronic device that communicates sounds to the earphone 700. For example, the electronic device 706 may be a radio, walkman, CD player, DVD player, cellular phone, or personal computer. Other examples of electronic devices are possible.

The earphone 700 is positioned in the pinna 714 of the ear and at least partially within the ear canal 711 of the ear. As with the example shown in FIG. 1, the ear is generally divided into the outer ear, the middle ear, and the inner ear. The outer ear includes the pinna 714; the middle ear includes the eardrum 716, ossicles 718, and Eustachian tube 720; and the inner ear includes the semicircular canals 726, round window 722, and cochlea 724.

The receiver module 701 includes various electrical and mechanical elements. For example, the receiver module may include a speaker (and the electrical and mechanical components of a speaker) and/or a microphone (and the electrical and components of a microphone). The receiver module 701 is coupled to the tube 708. In one example, the receiver module is a CI series receiver manufactured by Knowles Electronics, LLC. Other examples of receivers are possible. The tube 708 may be constructed of any suitable material such as plastic and, in one example, is approximately 10 mm long and 1 mm in diameter.

The barrier 710 is coupled to the receiver module 701 or disposed in close proximity to the receiver module 701 within the tube 708. In one example, the barrier 710 is a removable plug that includes a screen such as that shown in FIG. 6. In another example, the barrier 710 is a metal mesh screen. Other examples of barriers are possible. In the example of FIG. 7, a plug-like device is used and is coupled to the receiver module 701 by any convenient approach such as by using an adhesive.

The barrier 710 is configured so that sound passes through the barrier 710. At the same time, the barrier 710 is configured to prevent moisture intrusion into the receiver 701 from outside of the earphone 700. For example, the earphone 700 may be removed by the user from their ear when they go swimming or when they sleep to mention two examples. During this time when the earphone 700 is removed from the ear of the user and especially susceptible to attack by moisture or liquids (but also when it in the ear of the user), the present approaches prevent moisture intrusion into the earphone 700.

In preventing moisture intrusion, it is meant that moisture will not pass from one side of the barrier 710 to the other side of the barrier 710 for a given set of conditions or under a standard. To take one example, under Ingress Protection standards, the barrier 710 may have a rating of approximately 7 indicating no substantial water leakage occurs at a liquid depth of 1 meter for one-half hour. The degree of barrier moisture permeability selected by the user varies based upon the application and circumstances of the user.

It will be appreciated that the barrier 710 (or portions of the barrier) may also be treated with a moisture repellant material to further repel moisture. For example, the barrier 710 may be treated with a fluorocarbon based anti-wetting agent. Other examples of moisture repellant materials and treatments are possible.

The present arrangements prevent intrusion of substantially any liquid (e.g., water, a water mixture, or moisture) having a surface tension equal or greater than water into the receiver module 701. Additionally and as has been described elsewhere herein, equal or substantially equal pressures are maintained as between the exterior of the earphone and interior portions of the earphone 700. The equal or substantially equal pressures ensure proper operation of the receiver module 701.

The size and shape of the openings in the barrier 710 are selected to be small enough to prevent moisture form passing through the barrier at a selected fluid pressure. As mentioned and to take one example, the barrier is a metal mesh screen that has openings. In this example, the openings are circular holes of approximately 6.5 micrometer diameter and that produce an approximate 7 IP submersion rating for the barrier 710.

In some situations, the barrier 710 may act as a damping element that has a damping effect on sound that passes there though. At high frequencies the damping is greater than at lower frequencies. In fact, at DC frequencies no (or very little) damping may occur. In some examples, an additional high pass filter is used to compensate. This high pass filter can be disposed at either the electronic device 706 or the earphone 700. The power of the transmitted signal from the electronic device 706 may be increased as well. By "increasing" the power, what is meant is that the drive level is increased beyond that normally associated with the normal operation of earphones. For example, the power may be increased by approximately 400 percent, for example, from 0.1 Vrms to 0.4 Vrms over the drive level used during operations with no barrier present. The increased power and/or the high pass filter serve to pass high frequency signals through to the barrier 710 with little or no degradation of signal quality.

Figure 8:
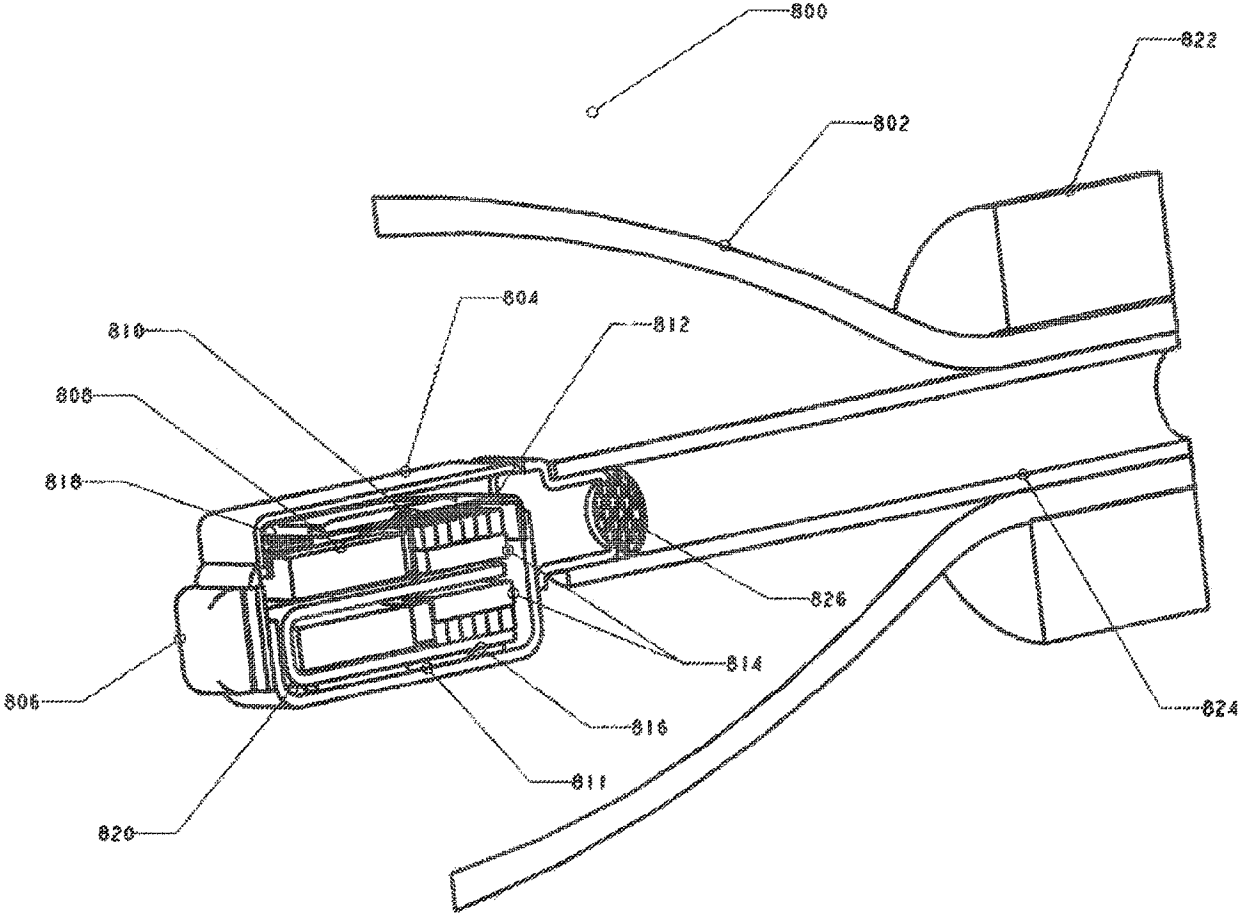
FIG. 8 is a cut-away perspective view of one example of another example of an apparatus including a speaker for preventing moisture intrusion into portions of an earphone.

Referring now to FIG. 8, one example of an apparatus for preventing moisture intrusion into portions of an earphone 800 is described. The earphone 800 includes a housing 802 that can be constructed of any suitable material such as plastic and/or metal. A speaker module 804 is disposed inside the housing 802. The speaker module 804 includes an input terminal 806, a coil 808, a drive rod 810, a diaphragm 812, magnets 814, an armature 816, a front cavity 818, and a rear cavity 820. The speaker module 804 may also include one or more pierced holes or openings, for example, in the diaphragm 812 to allow barometric venting or pressure equalization to occur. The speaker module 804 couples to the tube 824 at the front cavity. The tube 824 has a barrier 826 that is within the tube 824 and coupled to the speaker module 804. The speaker module 804 includes an outer housing 811 that houses the above-mentioned components and this outer housing 811 may be constructed of any suitable material such as plastic.

A flexible ear tip gasket 822 extends around portions of the tube 824 and housing 802. The flexible ear tip gasket 822 may be constructed from any suitable material such as those materials that are comfortable for human wear such as foam, rubber, or the like.

In operation, the speaker module 804 receives electrical signals from a device that is positioned outside of the earphone (e.g., the electronic device 706 of FIG. 7). In this respect, a wire (not shown in FIG. 8) from this outside device couples to the input terminal 806. In other aspects, the device may be positioned inside the earphone.

The coil 808 is driven by the received signals and induces a magnetic field on the armature 816 to move the armature 816. The magnets 814 have a permanent charge and as the armature 816 moves, the diaphragm 812 moves via the drive rod 812. The diaphragm 812 acts to create sounds in the tube 824 as the diaphragm 812 moves and these sounds are acoustically transmitted through openings in the speaker module, through the barrier 826, and then through the tube 824 to the ear of the user to be heard.

In this example, the barrier 826 is an attached tube/screen assembly. In this example, the openings of the barrier are circular holes of approximately 6.5 micrometer diameter and that produce an approximate 7 IP submersion rating for the barrier 826. Other examples and configurations of barriers are possible.

It will be appreciated that a barrier so configured and dimensioned to have such a small cross-sectional area comfortably fits into the human ear without causing significant discomfort or an injury to the user. Additionally, little or no reactance is introduced due to this small size. Therefore, the frequency response of the acoustic signal is not significantly degraded and significant distortion of this signal does not occur. Positioning the barrier at or near the speaker module 804 reduces the air volume behind the barrier.

It will be appreciated that in this example, the barrier prevents intrusion of substantially any liquid (e.g., water, a water mixture, or moisture) having a surface tension equal or greater than water from the exterior of the earphone into the speaker module 804. On the other hand and at the same time, sound can penetrate the barrier 826 to be heard by a user. As mentioned, a high pass filter can be added to the speaker module 804 and/or the power of the signal sent to the module 804 from the external device can be increased over the power which would be used in the absence of a screen. In this way, further improved reception by the user of high frequency signals from the external device may be achieved. In addition, the pressure external to the tube 824, within the tube 824, and within the front and rear cavities 818 and 820 is equalized or substantially equalized so that optimum operation of the speaker module 804 is achieved and maintained.

Figure 9:
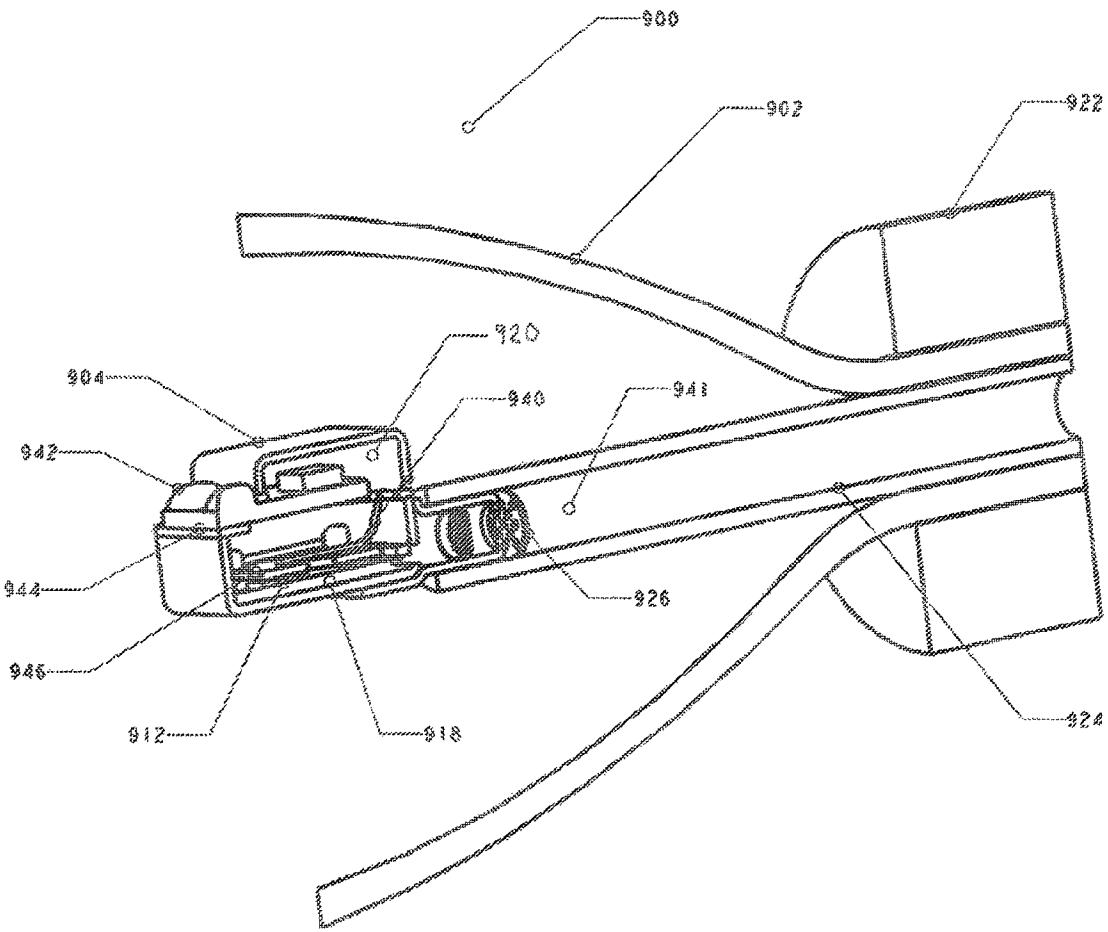
FIG. 9 is a cut-away perspective view of one example of another example of an apparatus including a microphone for preventing moisture intrusion into portions of an earphone.

Referring now to FIG. 9, another example of an apparatus for preventing moisture intrusion into portions of an earphone 900 is described. More specifically, intrusion of substantially any liquid (e.g., water, a water mixture, or moisture) having a surface tension equal or greater than water is prevented. The earphone 900 includes a housing 902 that can be constructed of any suitable material such as plastic. A microphone module 904 is disposed inside the housing 902. The microphone module 904 includes an output terminal 942, a wire 940, an amplifier 944, a charge plate 946, a diaphragm 912, a front cavity 918, and a rear cavity 920. The microphone module 904 may also include one or more pierced holes or openings, for example, in the diaphragm 912 to allow barometric venting or pressure equalization to occur. The microphone module 904 couples to the tube 924. The tube 924 has a barrier 926 attached or secured at the microphone module 904 by adhesive or some other fastening approach. A flexible ear tip gasket 922 extends around portions of the tube 924 and housing 902. The flexible ear tip gasket 922 may be constructed from any material that is comfortable for human wear such as foam or the like.

In operation, the microphone module 904 receives a sound pressure (indicated by an arrow labeled 941) via the tube 924. The sound pressure successfully moves past the barrier 926 via the tube 924 to the front cavity 918. The sound pressure 941 passes through openings in the microphone module and moves the diaphragm 912. Movement of the diaphragm 912 causes a change in charge of the charged plate 946, which connects to the amplifier 944 via the wire 940. The amplifier 944 couples to the output terminal 942 and lowers the impedance of the electrical signal for presentation at the output terminal 942.

In this example, the barrier 926 is a removable plug (that includes a screen). In this example, the openings of the barrier are circular holes of approximately 6.5 micrometer diameter and that produce an approximate 7 IP submersion rating for the barrier 926. Other examples and configurations of barriers are possible. Other examples of barriers and barrier construction are possible. Positioning the barrier at or near the microphone module 904 reduces the air volume behind the barrier.

It will be appreciated that in this example, the barrier 926 prevents all or substantially all moisture or liquid from the exterior of the earphone 900 to enter the microphone module 904. On the other hand, sound can penetrate the barrier 926 for processing by the microphone module 904. In addition, the pressure external to the tube 908, within the tube 908, and within the front and rear cavities 918 and 920 is equalized so that optimum operation of the microphone module 904 is achieved and maintained.

Figure 10:
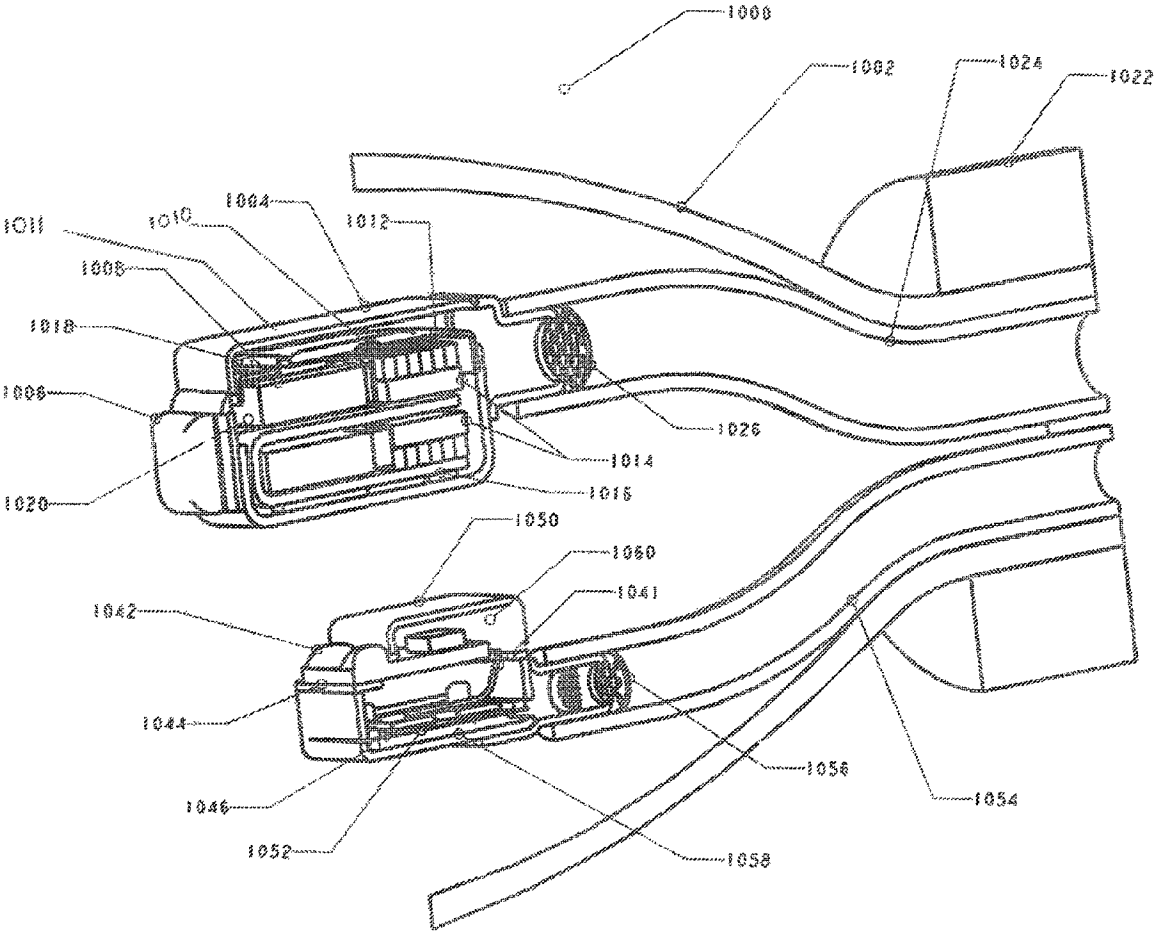
FIG. 10 is a cut-away perspective view of another example of an apparatus including a speaker and a microphone for preventing moisture intrusion into portions of an earphone.

Referring now to FIG. 10, another example of an apparatus for preventing moisture intrusion into portions of an earphone 1000 is described. In this example, both a microphone module and a speaker module are disposed within the earphone. More specifically, the earphone 1000 includes a housing 1002 that can be constructed of any suitable material such as plastic and/or metal. A speaker module 1004 is positioned inside the housing 1002. The speaker module 1004 includes an input terminal 1006, a coil 1008, a drive rod 1010, a diaphragm 1012, magnets 1014, an armature 1016, a front cavity 1018 and a rear cavity 1020. The speaker module 1004 may also include one or more pierced holes or openings, for example, in the diaphragm 1012 to allow barometric venting or pressure equalization to occur. The speaker module 1004 couples to the tube 1024 at the front cavity 1018. The tube 1024 has disposed within it a barrier 1026 that is attached (via any fastening approach such as an adhesive) to the speaker module 1004. The speaker module 1004 includes an outer housing 1011 and this outer housing 1011 may be constructed of any suitable material such as plastic. The operation of these components is the same as that for similar components of FIG. 8 and will not be discussed again here.

A flexible ear tip gasket 1022 extends around portions of the tube 1024 and housing 1002. The flexible ear tip gasket 1022 may be constructed from any material that is compatible or comfortable for human wear such as foam or the like.

Further, in the example of FIG. 10 a microphone module 1050 is also positioned inside the housing 1002. The microphone module 1050 includes an output terminal 1042, a wire 1041, an amplifier 1044, a charge plate 1046, a diaphragm 1052, a front cavity 1058, and a rear cavity 1060. The microphone module 1050 may also include one or more pierced holes, for example, in the diaphragm 1052 to allow barometric venting or pressure equalization to occur. The microphone module 1050 couples to the tube 1054. The tube 1054 has disposed within it a barrier 1056 that is attached to the microphone module 1050 via any fastening approach such as using an adhesive. The flexible ear tip gasket 1022 extends around portions of the tube 1054. The operation of these components is the same as for similar components in FIG. 9 and will not be discussed again here.

As can be seen in FIG. 10, each of the tubes 1024 and 1054 has separate barriers disposed therein. In other examples, a single tube is used and attaches to both the speaker module 1004 and the microphone module 1050.

It will be appreciated that in this example, the barriers 1026 and 1056 prevent all or substantially all moisture from the exterior of the earphone from entering the modules 1004 and 1050. More specifically, intrusion of substantially any liquid (e.g., water, a water mixture, or moisture) having a surface tension equal or greater than water is prevented. On the other hand, sound can penetrate the barriers 1026 and 1054 to be heard by a user and received at the microphone module 1050. In conjunction with the speaker module 1004, a high pass filter can be added to the speaker module 1004 and/or the power of the signal sent to the module 1004 from the external device can also be increased over the power that would be used in the absence of a barrier. In this way, further improved reception by the user of high frequency signals from the external device may be achieved. In addition, the pressures external to the tubes 1024 and 1054, within the tube 1024 and 1054, and within the front and rear cavities 1018, 1058 and 1020, 1060 are equalized or substantially equalized so that optimum operation of the speaker module 1004 and the microphone module 1050 is achieved and maintained.

Figure 11:
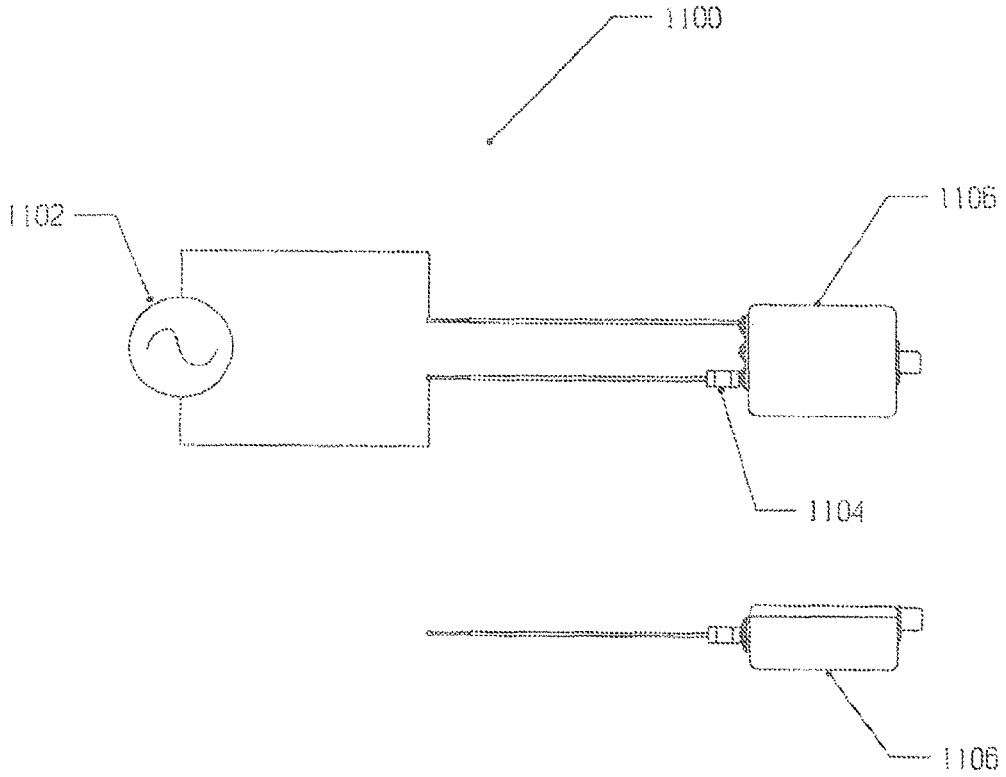
FIG. 11 illustrates different views of an acoustic system with a speaker that prevents moisture intrusion and shows an equalization device deployed within the system.
Figure 12:
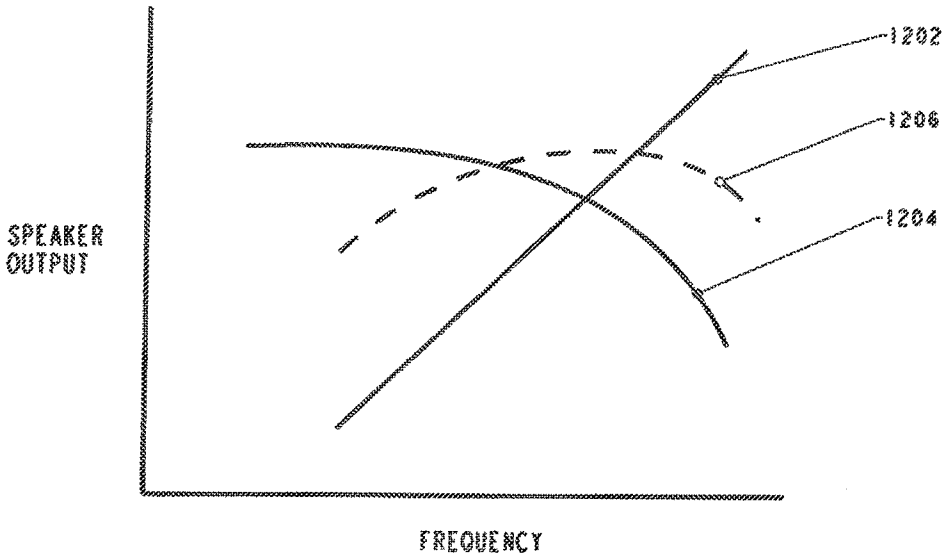
FIG. 12 is a graph showing the response of the system of FIG. 11.

Referring now to FIGS. 11 and 12, one example of a system 1100 that prevents moisture intrusion into a speaker module 1106 and uses an equalization device 1104 (e.g., a high pass filter) to obtain desired sound quality is described. The speaker module 1106 can be any of the speaker modules described elsewhere herein. A signal source 1102 drives the speaker module 1106.

In this example, a barrier screen (not shown) overdamps the receiver frequency response. Adding the high-pass filter 1104 (e.g., in the form of a series capacitor compensator) compensates for the damping and creates a net response that sounds more natural for voice communication. In one example, the equalization device is a series chip capacitor in the signal path. Further, the signal may be compensated in other ways and in other locations (e.g., other forms of equalizers disposed at other locations). As shown in FIG. 12, the speaker response (with damping) 1204 would lead to damping, especially at higher frequencies. A filter response 1202 shows the compensation that is applied to the signal by the filter. The resultant net response 1206 shows the resultant signal after the application of the high pass filter (or other equalization device or devices) to the over-damped signal.

Figure 13:
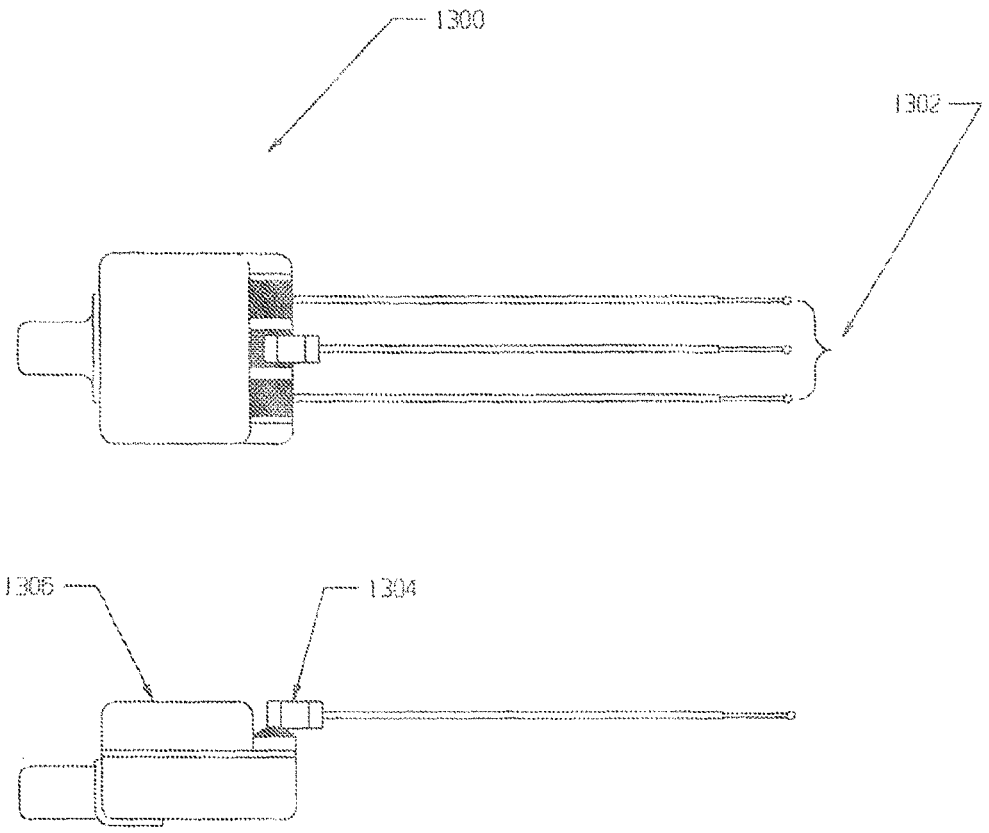
FIG. 13 illustrates views of an acoustic system with a microphone that prevents moisture intrusion and shows an equalization device deployed within the system.
Figure 14:
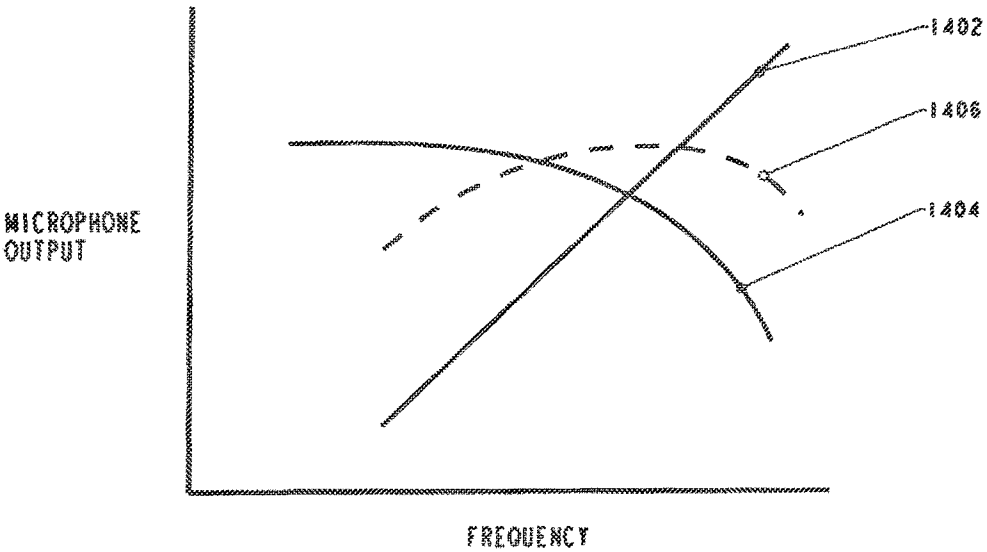
FIG. 14 is a graph showing the response of the system of FIG. 13.

Referring now to FIGS. 13 and 14, one example of a system 1300 that prevents moisture intrusion into a microphone module 1306 and uses an equalization device 1304 (e.g., a high pass filter) to obtain desired sound quality is described. The microphone module 1306 can be any of the microphone modules described elsewhere herein. The microphone module 1306 produces an output signal that may be further used by a processing device.

In this example, a barrier screen (not shown) overdamps the frequency response of audio signals received at the microphone. Adding the high-pass filter 1304 (e.g., in the form of a serial capacitor) compensates for the damping and creates a response that sounds more natural for listeners. In one example, the device 1304 is a series chip capacitor in the signal path. The damping of the signal may be compensated in other ways and other locations. (e.g., by other equalizer devices deployed at other locations). As shown in FIG. 14, the microphone response (with damping) 1404 would lead to damping, especially at higher frequencies. A filter response 1402 shows the compensation that is applied to the signal by the filter. The resultant net response 1406 shows the resultant signal after the application of the high pass filter (or other equalization device or devices) to the overdamped signal.

Thus, approaches are provided whereby an acoustic tube of an earphone is mounted with a barrier and the barrier prevents all or substantially all moisture intrusion into the acoustic tube. At the same time, the barrier is configured to allow sound to pass therethrough so that the quality of the sound does not become significantly degraded. In some embodiments, the barrier is attached to the receiver and/or the microphone.

Preferred embodiments of this disclosure are described herein, including the best mode known to the inventor(s). It should be understood that the illustrated embodiments are exemplary only, and should not be taken as limiting the scope of the appended claims.

What is claimed is:

1. An acoustic system comprising:

transducer means for creating or processing an acoustic signal;

means for conveying an acoustic signal, wherein the means for conveying are coupled to the transducer means and the acoustic signal travels along a length of the means for conveying; and a screen disposed across a passage of the means for conveying, wherein the screen prevents moisture from traversing the length of the means for conveying toward the transducer means, wherein the screen dampens any audio signal traversing the means for conveying; and wherein the screen is configured to have a submersion rating greater than or equal to a 7 Ingress Protection rating.

2. The acoustic system of claim 1, wherein the transducer means comprises a receiver that outputs an acoustic signal representative of a received electrical signal.

3. The acoustic system of claim 1, wherein the transducer means comprises a microphone that outputs an electrical signal representative of the acoustic signal received from the means for conveying.

4. The acoustic system of claim 1, wherein the transducer means further comprises means for equalizing, wherein the means for equalizing counteracts the damping effect of the screen.

5. The acoustic system of claim 1, wherein the means for conveying comprises a flexible plastic tube.

6. The acoustic system of claim 1, wherein the comprises screen is a metal mesh having circular openings of approximately 6.5 microns in diameter.

7. The acoustic system of claim 6, wherein the metal mesh is coated with a fluorocarbon based anti-wetting material.

8. An acoustic system comprising:

a receiver capable of outputting an acoustic signal representative of a received electrical signal;

a conduit coupled to an output of the receiver, wherein the acoustic signal traverses a length of the conduit; and a rigid moisture resistant barrier comprising a screen that is disposed along a passage of the conduit to prevent moisture from traversing the length of the conduit towards the receiver, wherein the moisture resistant barrier dampens any audio signal traversing the conduit; and wherein the moisture resistant barrier is configured to have a submersion rating at least equal to a 7 Ingress Protection rating.

9. The acoustic system of claim 8, wherein the receiver further comprises a high pass filter for counteracting the damping effect of the moisture resistant barrier.

10. The acoustic system of claim 8, wherein the screen comprises a metal mesh having circular openings of approximately 6.5 microns in diameter.

11. The acoustic system of claim 10, wherein the metal mesh is coated with a fluorocarbon based anti-wetting material.

12. The acoustic system of claim 8, wherein the screen comprises a metal mesh and is coupled to an end of the conduit with a bushing and adhesive.

13. The acoustic system of claim 8, wherein the screen comprises a metal mesh and is configured as a removable plug for insertion into an open end of the conduit.

14. The acoustic system of claim 8, wherein the screen comprises a metal mesh and is configured as a removable screw-on component that mates with threads disposed on an end of the conduit.

15. An acoustic system comprising:

a conduit, wherein an acoustic signal traverses a length of the conduit; and a microphone coupled to an end of the conduit, wherein the microphone is capable of processing an acoustic signal traversing the conduit; and a rigid moisture resistant barrier comprising a screen that is disposed along a passage of the conduit to prevent moisture from traversing the length of the conduit towards the receiver, wherein the moisture resistant barrier dampens any audio signal traversing the conduit; and wherein the moisture resistant barrier is configured to have a submersion rating at least equal to a 7 Ingress Protection rating.

16. The acoustic system of claim 15, wherein the microphone further comprises a high pass filter for counteracting the damping effect of the moisture resistant barrier.

17. The acoustic system of claim 15, wherein the screen comprises a metal mesh having circular openings of approximately 6.5 microns in diameter.

18. The acoustic system of claim 17, wherein the metal mesh is coated with a fluorocarbon based anti-wetting material.

19. The acoustic system of claim 15, wherein the screen comprises a metal mesh and is coupled to an end of the conduit with a bushing and adhesive.

20. The acoustic system of claim 15, wherein the screen comprises a metal mesh and is configured as a removable plug for insertion into an open end of the conduit.

21. The acoustic system of claim 15, wherein the screen comprises a metal mesh and is configured as a removable screw-on component that mates with threads disposed on an end of the conduit.

* * * * *